US009985350B2

(12) United States Patent
Nannetti et al.

(10) Patent No.: US 9,985,350 B2
(45) Date of Patent: May 29, 2018

(54) MULTIBAND ANTENNA FOR USE IN VEHICLES

(71) Applicant: Polomarconi Telsa SPA, Osio Sotto (IT)

(72) Inventors: Massimo Nannetti, Sotto il Monte Giovanni XXIII (IT); Alberto Panizza, Volta Mantovano (IT); Michele Picerno, Bergamo (IT)

(73) Assignee: Polomarconi Telsa SPA, Osio Sotto (BG) (IT)

( * ) Notice: Subject to any disclaimer, the term of this patent is extended or adjusted under 35 U.S.C. 154(b) by 26 days.

(21) Appl. No.: 15/385,374

(22) Filed: Dec. 20, 2016

(65) Prior Publication Data

US 2017/0207533 A1 Jul. 20, 2017

(30) Foreign Application Priority Data

Jan. 20, 2016 (IT) ..... 102016000005041

(51) Int. Cl.

| | |
|---|---|
| ***H01Q 5/307*** | (2015.01) |
| ***H01Q 1/32*** | (2006.01) |
| ***H01Q 1/38*** | (2006.01) |
| ***H01Q 1/42*** | (2006.01) |

(52) U.S. Cl.

CPC ..... *H01Q 5/307* (2015.01); *H01Q 1/3275* (2013.01); *H01Q 1/38* (2013.01); *H01Q 1/42* (2013.01)

(58) Field of Classification Search

CPC ..... H01Q 1/3275; H01Q 5/307
See application file for complete search history.

(56) References Cited

U.S. PATENT DOCUMENTS

| | | | | |
|---|---|---|---|---|
| 7,027,004 | B2 * | 4/2006 | Haunberger | H01Q 1/40 343/790 |
| 8,081,126 | B2 * | 12/2011 | Ikeda | H01Q 1/1207 343/700 MS |
| 2005/0134511 | A1 | 6/2005 | Haunberger et al. | |
| 2009/0207084 | A1 | 8/2009 | Ikeda et al. | |
| 2011/0012802 | A1 | 1/2011 | Weinstein et al. | |
| 2015/0311593 | A1 * | 10/2015 | Fasenfest | H01Q 13/02 343/786 |

OTHER PUBLICATIONS

Italian Search Report dated Oct. 3, 2016, in Italian Application No. ITUS20160249.

* cited by examiner

*Primary Examiner* — Jessica Han
*Assistant Examiner* — Amal Patel
(74) *Attorney, Agent, or Firm* — Workman Nydegger

(57) ABSTRACT

A multiband antenna for transmitting and receiving a range of frequencies substantially between 150 MHz and 6 GHz of the type having: a base plate-like conductive element connected to a connected-mass conductive surface; a first radiant element configured to transmit and receive in a frequency range substantially between 698 MHz and 6 GHz; a second radiant element connected—at the upper part—to said first radiant element and configured so as to collaborate with the first radiant element to transmit and receive in a frequency range substantially between 400 MHz and 500 MHz; a radiant unit configured to transmit and receive in the frequency range substantially between 216 MHz and 223 MHz and in the frequency range substantially between 159 MHz and 163 MHz; an electrical connector with an external device, mechanically and electrically connected to the vertex of the first radiant element.

15 Claims, 6 Drawing Sheets

MULTIBAND ANTENNA FOR USE IN VEHICLES

CROSS-REFERENCE TO RELATED APPLICATIONS

This application claims priority to Italian Application No. 102016000005041, filed Jan. 20, 2016, which is incorporated herewith.

BACKGROUND OF THE INVENTION

1. The Field of the Invention

The invention regards a multiband antenna for application in vehicles operating in a frequency range substantially comprised between 150 MHz and 6 GHz, more precisely between 159 MHz and 5945 MHz.

2. The Relevant Technology

It is known that the geometric dimensions of an antenna are closely bound to the wavelength associated to the minimum operating frequency of the antenna.

It is also known that in many situations, in particular in vehicles, there arises the need to find a compromise as concerns the dimensions of the antenna in particular as concerns the height thereof, taking into account the functional needs thereof even at very low frequencies, like in the case of the 159 MHz VHF band on the one hand, and—on the other—the structural restrictions required of infrastructures on which the vehicles, in which such antennas must be installed, are suitable to circulate. For example, in the case of antennas made for installation on the roofs of trains, in particular of locomotives thereof, the overall maximum height of the same, antennas included, must meet strict dimensional requirements related to the need of the aforementioned trains to pass through tunnels.

Furthermore, it is known that on the roofs of locomotives, where there are usually mounted the telecommunication apparatus, in particular the aforementioned antennas, there are present other systems not necessarily for telecommunication, that strongly limit the useful surface for the installation of the antennas in question.

Thus, there arises a substantial need to obtain such antennas with sufficiently compact design and dimensions, especially as concerns the height thereof.

Besides such dimensional need, the antennas suitable to be installed on trains, in particular on the locomotives, must be capable of operating in a wide range of frequencies. In particular, for use in the railway sector and, in particular, in the American railway sector, such antennas must be designed to cover VHF frequency bands from 159 MHz to 163 MHz and from 216 MHz to 223 MHz, the UHF frequency band from 450 MHz to 460 MHz, 4G frequency bands from 698 MHz to 960 MHz, from 1710 MHz to 2170 MHz and from 2500 MHz to 2690 MHz. Lastly, such antennas must be capable of operating in the Wi-Fi frequency hands from 2400 MHz to 2485 MHz and from 4900 MHz to 5945 MHz, so as to be usable both in telecommunication applications regarding railway traffic systems (Positive Train Control PTC, Voice, End Of Train EOT, Head Of Train HOT, Distributed Power DP) and for infotainment systems and services (4G and Wi-Fi).

Furthermore, it is known that the aforementioned types of antennas must have a sufficiently robust design so as to guarantee a reliable radio connection despite of the vibration of the systems operating on hoard the train and despite of any other extremely hard environmental disturbance, typical of railway operating fields.

Currently, there are antenna solutions that try to meet all these needs. In particular, the operation of the multiple band is obtained by providing a plurality of antennas, single-element, each operating separately in one or at most two sub-frequency bands of the multiband system indicated above. Such multiple single antennas are in particular arranged in the same cover structure, known as radome. However, disadvantageously, such type of solution provides for that each antenna be provided with an RF coaxial cable for descent through one or more holes made on the roof of a locomotive to connect each of the aforementioned antennas to a specific external filtering and/or processing device.

Furthermore, still disadvantageously, in most cases, such prior art solutions require the presence—in the vicinity of the aforementioned plurality of antennas—of multiple channel filters with the aim of guaranteeing the required insulation between the various channels, i.e. between the various sub-frequency bands.

Disadvantageously, such characteristics entail the need of carrying out complex and expensive installation operations.

The aim of the present invention is to overcome all the aforementioned drawbacks.

In particular, one of the objects of the invention is to provide a multiband antenna structure with compact dimensions, in particular with a low profile height-wise.

A further object of the invention is to provide a multiband antenna capable of simultaneously operating in a frequency range substantially comprised between 150 MHz and 6 GHz and simultaneously guarantee the required insulation between the various channels. Actually, such insulation between various channels, i.e. between the various operating sub-frequency bands, may be simply obtained by connecting the only output of the antenna of the invention, in particular the only descent RF coaxial cable, to a single filtering system ("multiplexer") that can be provided in the vehicles in which the aforementioned antenna is used.

Another object of the invention is to provide a multiband antenna that is sufficiently robust to enable the correct operation thereof even in the presence of vibrations or other external disturbances, like the extremely hard ones known in the railway sector.

Last but not least, an object of the invention is to provide a multiband antenna that can be installed in a simple, quick and cost-effective manner.

The aforementioned objects are attained by a multiband antenna according to the main claim.

In particular, the multiband antenna of the invention is characterized in that it provides for a first mono-cone-shaped radiant element, operating with a broadband in frequencies between 698 MHz and 6 GHz, a second substantially cylindrical-shaped radiant element superimposed on such first radiant element and whose combination enables transmitting and receiving in the UHF frequency band between 400 MHz and 500 MHz. Furthermore, the multiband antenna of the invention provides for a radiant unit in turn comprising a first radiant section with a substantially longitudinal extension to which there is operatively connected a suitable VHF bandpass filter to which there is in turn connected a radiant section.

Furthermore, the preferred embodiment of the invention provides for that to the first radiant section there be connected a third substantially trapezoid-shaped radiant section. In particular, such third radiant section, according to the invention, essentially extends transversely to the aforementioned first radiant section, as specified hereinafter.

Lastly, the first radiant section, according to the invention, is electrically earthed in a suitable position, through the electrical contact with the base plate, through a suitable earthing conductive contact.

The combination of the aforementioned elements belonging to the radiant unit, as described in detail hereinafter, enables the unit, collaborating with the previous first radiant element and second radiant element, to simultaneously operate in two VHF frequency bands, one from 159 MHz to 163 MHz and the other from 216 MHz to 223 MHz. Furthermore, the multihand antenna of the invention comprises a base plate-like conductive element capable of providing an optimal electrical and mechanical interface between the antenna installation surface and the antenna itself.

As mentioned above, the antenna is electrically connected to the base plate so as to provide an earthing contact that is sufficiently robust to meet the strict earthing requirements for the safety of the personnel, required of the devices operating in the railway sector, especially in sectors that mainly use electric traction from high voltage power lines arranged above the roof of the train.

Lastly, the antenna has a single connector, thus a single RF coaxial cable, which enables connecting the antenna to a suitable external device that can operate in a single frequency band among those indicated above or in two or more sub-bands simultaneously or in all simultaneously.

The presence of a single RF coaxial cable is guaranteed by the continuous structure of the antenna of the invention and not of the discrete type like in the prior art solutions.

It should be observed that in this context, the term "radiant" with reference to radiant elements and sections belonging to the antenna of the invention is used to describe the capacity of the radiant elements and sections in question to radiate and/or absorb electromagnetic energy, thus their capacity to receive and transmit electromagnetic signals falling, as specified hereinafter, in the aforementioned range of frequencies substantially between 150 MHz and 6 GHz. To this end, it is clear that all radiant elements and sections belonging to the antenna of the invention and described hereinafter in detail are made of electrically conductive material.

Further characteristics of the multiband antenna of the invention are outlined in the dependent claims.

BRIEF DESCRIPTION OF THE DRAWINGS

The aforementioned objects and advantages, shall be outlined in the description of a preferred embodiment of the invention, provided solely by way of non-limiting example, with reference to the attached drawings wherein.

DETAILED DESCRIPTION OF THE PREFERRED EMBODIMENTS

The multiband antenna of the invention is represented in different views in FIGS. 1 to 4, where it is indicated in its entirety with 1. The multiband antenna 1 of the invention is generally configured for transmitting and receiving in a range of frequencies substantially comprised between 150 MHz and 6 GHz, in particular between 159 MHz and 5945 MHz, and it is suitable to be installed in vehicles, in particular train locomotives.

Figure 1:
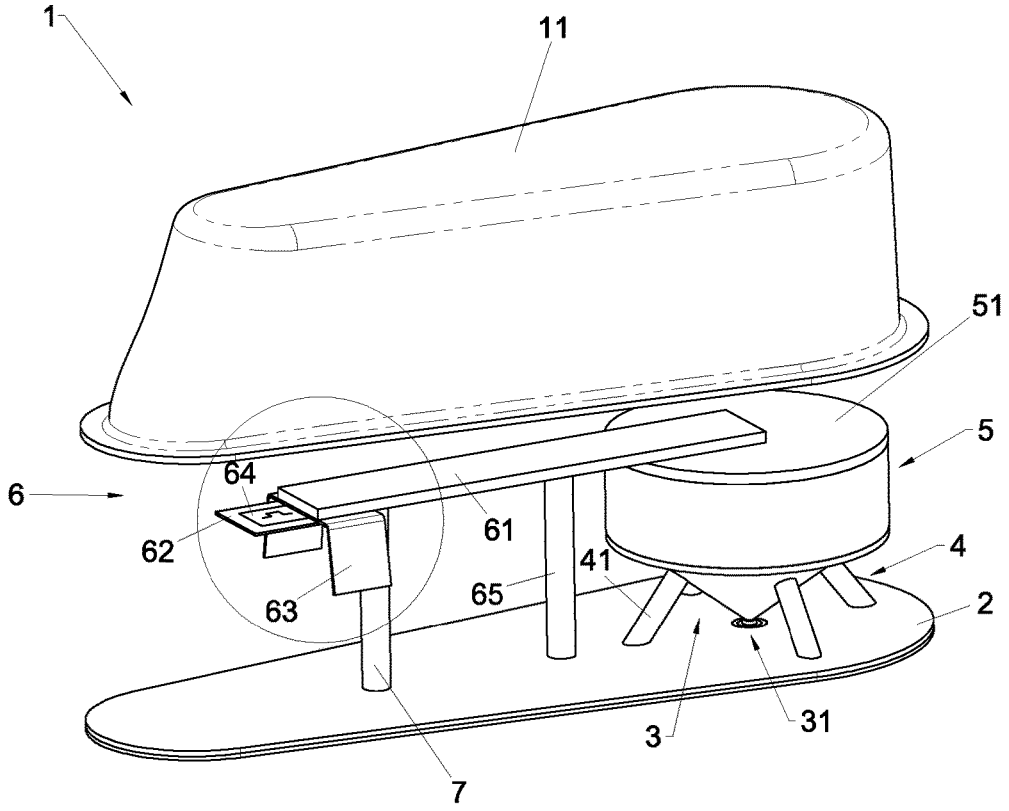
FIG. 1 represents the multiband antenna of the invention according to an axonometric view.

In particular, as observable in FIG. 1, the multiband antenna 1 comprises a base plate-like conductive element 2, from now henceforth more simply referred to as base element 2, with a substantially longitudinal extension and configured to be earth-connected. In particular, the base element 2 is suitable to be directly connected to an earth connected conductive roof of a locomotive, or a vehicle more generally, or an earth-connected conductive surface of suitable minimum dimensions.

Preferably, such base element 2 is made of an aluminum alloy and it is configured to enable a simple and robust mechanical fixing of the aforementioned multiband antenna 1 on such roof of a locomotive.

Figure 2:
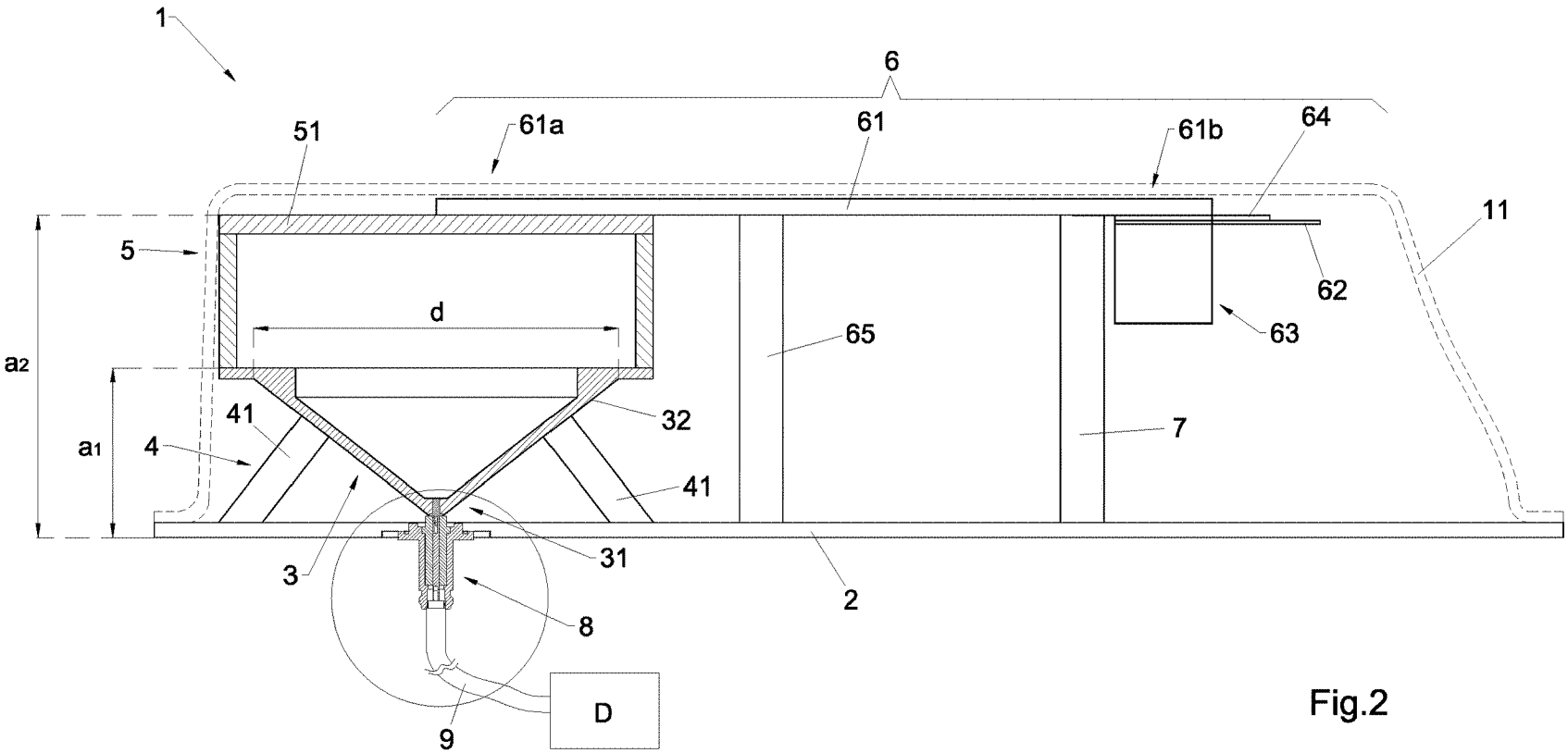
FIG. 2 represents the multiband antenna of the invention according to a lateral view.

The multiband antenna 1 of the invention, further comprises a first radiant element 3 substantially mono-cone-shaped. Such first radiant element 3, as represented in FIG. 2, is arranged and mechanically connected with the vertex 31 thereof facing towards the base element 2. Such first radiant element 3, as described in detail hereinafter, is also electrically insulated from the aforementioned base element 2. Furthermore, according to the invention, such first radiant element 3, with the configuration described above, is capable of transmitting and receiving in a frequency range substantially comprised between 698 MHz and 6 GHz.

In particular, according to the preferred embodiment herein described and represented in FIGS. 1 to 4, the first radiant element 3 has a height a1 comprised between 50 and 70 mm, preferably about 60 mm.

In addition, still according to the preferred embodiment of the invention, such first radiant element 3 has a base diameter d comprised between 160 and 180 mm, preferably 168 mm.

However, it is not excluded that according to different embodiments of the invention, the first radiant element 3 may have different shapes and dimensions with respect to those described above regarding the preferred embodiments of the invention, as long as they are capable of transmitting and receiving within the aforementioned frequencies and as long as they have an overall compact dimension.

On the other hand, as concerns the system for fixing the first radiant element 3 to the base element 2, it is obtained by means of a plurality of support elements 4 made of insulating material. In particular, as observable in FIGS. 2 and 4, such plurality of support elements 4 is made of polyoxymethylene (POM) and each of them is arranged between the outer surface 32 of the first radiant element 3 and the base element 2 with an angle substantially equivalent to 90° with respect to such outer surface 32.

Even more in detail, preferably but not necessarily, as observable in FIG. 2, such support elements 4 are four support columns 41. Generally, for any embodiment of the invention, such support elements 4 must comprise, at least, three support columns 41, so as to provide suitable support for the first radiant element 3. Advantageously, such characteristics enable a suitable insulation of the first radiant element 3 with respect to the earth-connected base element 2. In particular, the base element 2 is suitable to be directly connected to an earth connected conductive roof of a locomotive, or a vehicle more generally, or an earth-connected conductive surface of suitable minimum dimensions.

Furthermore, such configuration, in particular the 90° inclination angle between the outer surface 32 of the first radiant element 3 and the support elements 4, alongside the number of the latter, enables the structure thus obtained to have high robustness and stability even in the presence of external mechanical stresses, such as for example the known vibrations that occur in the railway sector.

The multiband antenna 1 of the invention further comprises, as observable in FIGS. 1 to 4, a second substantially cylindrical-shaped radiant element 5.

Such second radiant element 5 is suitably mechanically and electrically connected, at the top part, to the aforementioned first radiant element 3.

According to the invention, the second radiant element 5 is configured so as to collaborate with the first radiant element 3 so as to transmit and receive in a frequency range substantially comprised between 400 MHz and 500 MHz.

In particular, according to a preferred embodiment of the invention, the combination of the first radiant element 3 and the second radiant element 5 has an overall height a2 comprised between 130 and 150 mm, preferably about 138 mm.

Furthermore, the multiband antenna 1 of the invention comprises a radiant unit, indicated in its entirety, in FIGS. 1 to 4, with 6.

In detail, such radiant unit 6 in turn comprises a first radiant section 61 with substantially longitudinal and plate-like extension having a first end 61*a* suitably mechanically and electrically connected to the top part 51 of said second radiant element 5.

Furthermore, the aforementioned first radiant section 61 is substantially arranged in a position parallel to the base element 2, as observable in FIG. 2. In addition, the first radiant section 61 of the radiant unit 6 is suitably electrically and mechanically connected with the base element 2 by means of an earthing conductive element, in particular an earthing conductive column 65, belonging to the same radiant unit 6.

More precisely, as observable in FIGS. 1 and 2, such conductive column 65 is arranged in proximity of the first end 61*a* of the first radiant section 61 and thus in proximity of the aforementioned first radiant element 3 and second radiant element 5.

According to the invention, the first radiant section 61 is configured so as to collaborate with the first radiant element 3 and with the second radiant element 5 to transmit and receive in a frequency range substantially comprised between 216 MHz and 223 MHz.

According to the preferred embodiment, the radiant unit 6 preferably but not necessarily also comprises a third radiant section 63 essentially trapezoid-shaped and suitably mechanically and electrically associated at the second end 61*b* of the first radiant section 61.

Figure 5:
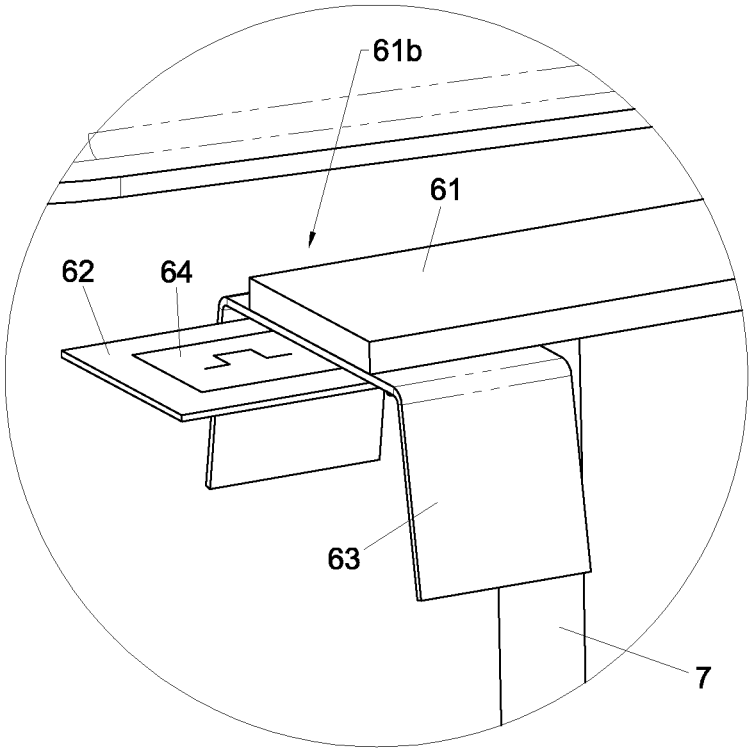
FIG. 5 represents the detail of the radiant unit belonging to the antenna of the invention, in which there is identified the third substantially trapezoid-shaped radiant section.

In particular, the third radiant section 63 essentially extends transversely to the aforementioned first radiant section 61, as observable in particular in FIG. 5.

The presence of the aforementioned third radiant section 63 advantageously enables reducing the dimensions of the first radiant section 61, in particular the length-wise extension thereof with the aim of transmitting and receiving within the range of frequencies indicated above. Actually, in the absence of such third radiant section 63, the first radiant section 61 should have dimensions that are larger than those of the preferred embodiment described herein so as to be able to transmit and receive within the range of frequencies substantially comprised between 216 MHz and 223 MHz.

Even more in detail, according to the preferred embodiment of the antenna 1 of the invention, such first radiant section 61 has a length comprised between 298 and 418 mm, preferably about 358 mm.

In addition, according to the preferred embodiment of the invention, as observable in FIG. 5, the third radiant element 63 has a width comprised between 98 and 118 mm, preferably about 108 mm, a height comprised between 40 and 60 mm, preferably about 50 mm, a depth comprised between 35 and 55 mm, preferably about 45 mm and an opening angle comprised between 90° and 110°, preferably about 100°.

However, it cannot be excluded that, according to different embodiments of the invention, the third radiant conductive element 63 has different shape and dimensions, with respect to the one indicated above as the preferred embodiment of the invention, as long as once suitably mechanically and electrically connected to the first radiant section 61 and the latter to the conductive column 65, the three elements collaborate with the first radiant conductive element 3 and with the second radiant conductive element 5 to transmit and receive in the range of frequencies indicated above and substantially comprised between 216 MHz and 223 MHz.

Furthermore, it is not excluded that, according to different embodiments of the invention, such third radiant section 63 be absent, as long as the first radiant section 61, suitably dimensioned as observed above, is capable of transmitting and receiving within the frequency range substantially comprised between 216 MHz and 223 MHz.

In addition, with the aim of suitably supporting the first radiant section 61, the multiband antenna 1 of the invention provides for a support element 7 made of insulating material and arranged between the base element 2 and the first radiant section 61, in proximity of the second end 61*b* of the latter.

Preferably, such support element 7 is made of polyoxymethylene (POM).

Advantageously, the presence of the conductive column 65 and the aforementioned support element 7, enables the multiband antenna 1 of the invention to obtain suitable robustness and mechanical stability.

Furthermore, the conductive column 65 enables providing the entire radiant structure an earthing contact that is sufficiently robust to meet the strict earthing requirements for the safety of the personnel, required of devices operating in the railway sector. In particular, such robust earthing is required in sectors that mainly use electric traction from high voltage cables arranged above the roof of a train, where the antenna must, in compliance with the inherent tests provided for, bear AC and DC voltages up to 25 kV and currents up to 40 kA in case of contact with the high voltage electrical power supply lines.

Lastly, advantageously, the conductive column 65 enables providing the radiant unit 6 the inductive component required to obtain a satisfactory adaptation of the antenna in the VHF bands, in that antennas of the compact type, like the one of the invention, have an inherent capacitive behavior.

Figure 3:
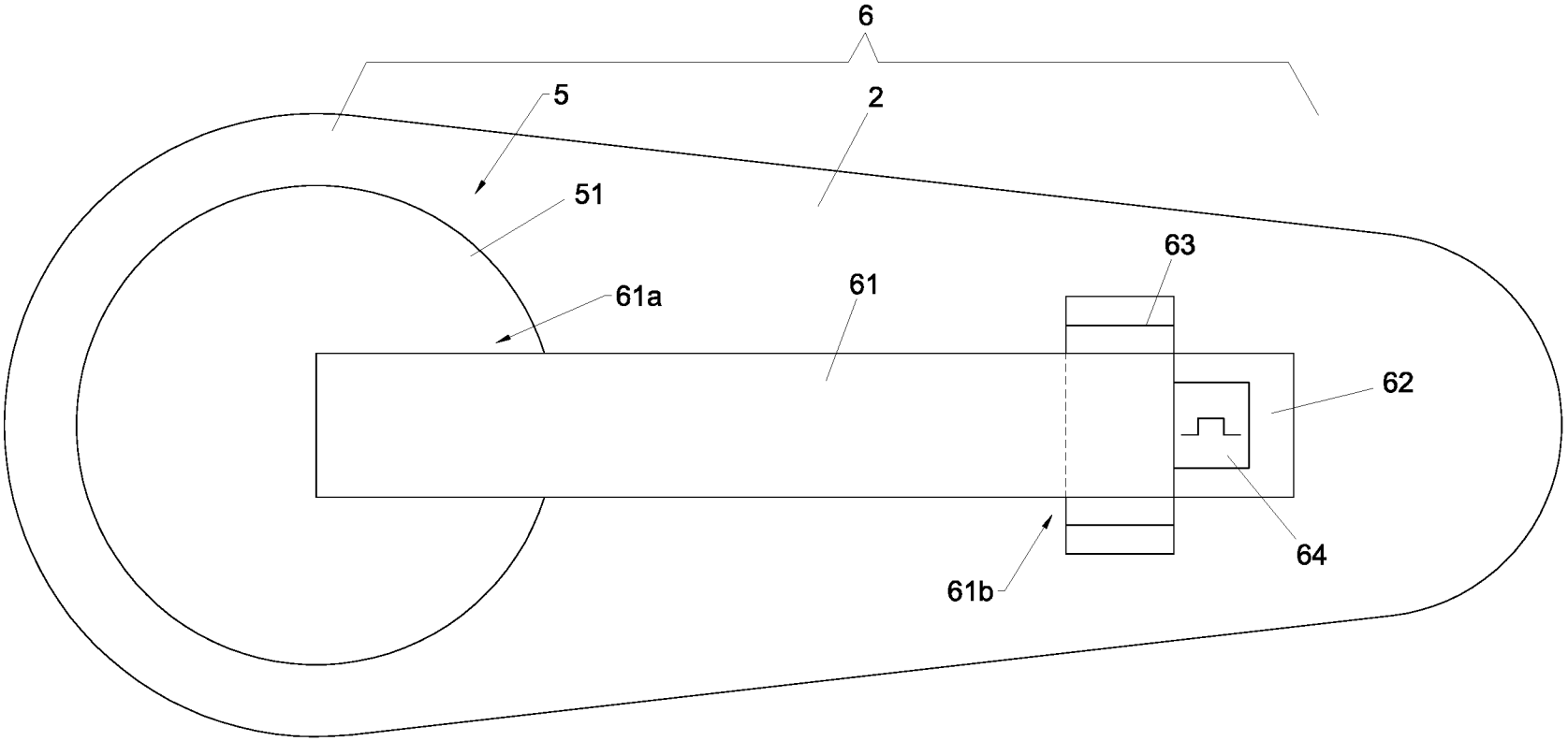
FIG. 3 represents the multiband antenna of the invention according to the top view.
Figure 4:
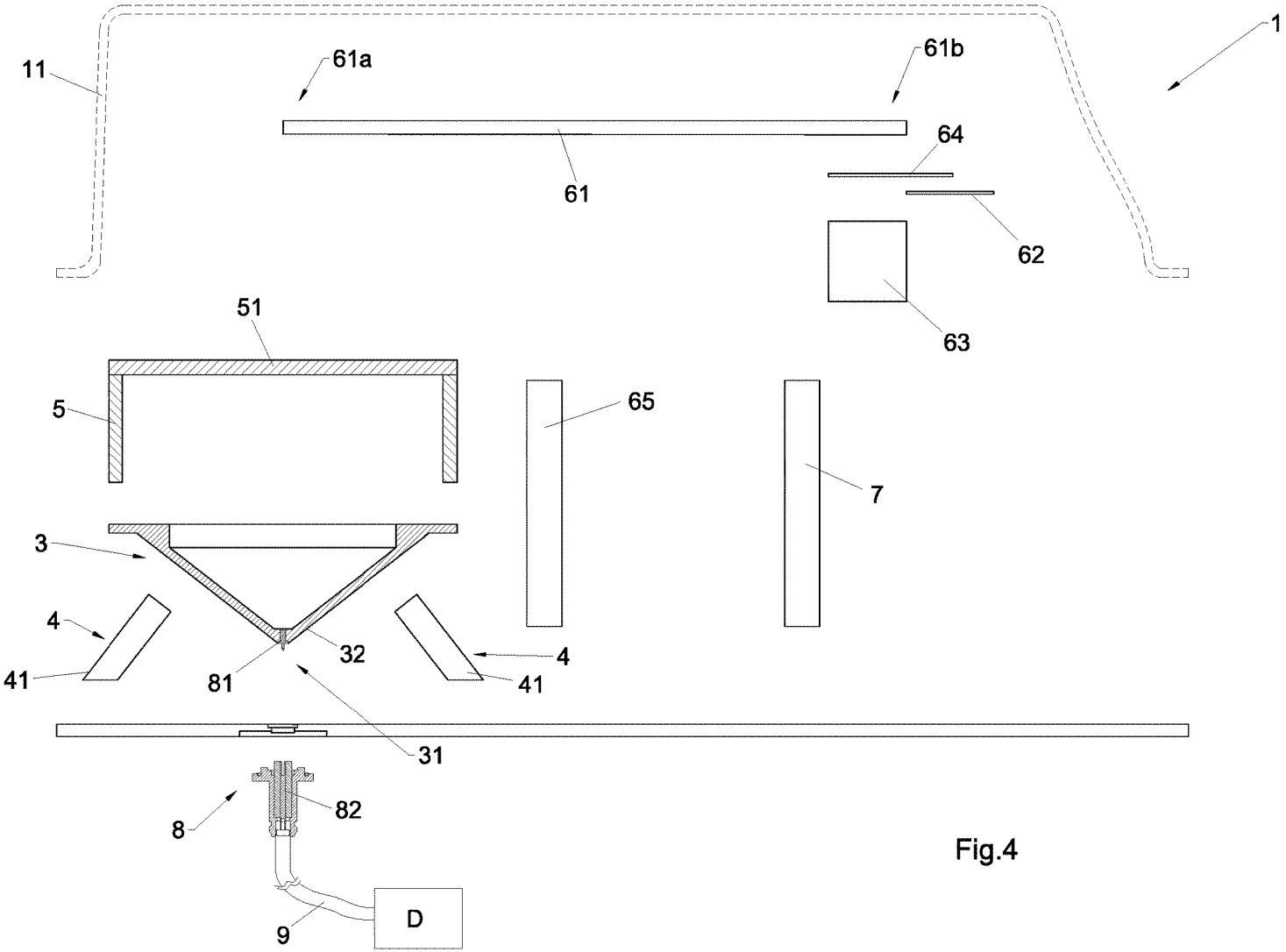
FIG. 4 represents the multiband antenna of the invention according to the exploded lateral view.

Preferably, as mentioned, such first radiant section 61 has a plate-like extension, as observable in FIGS. 1 and 3.

However, it is not excluded that, with the aim of further enhancing such robustness of the multiband antenna 1, the first radiant section 61 can be configured so as to be U-shaped in the direction of the longitudinal extension axis thereof.

The radiant unit 6 belonging to the multiband antenna 1 of the invention further comprises, as represented in FIG. 3, a bandpass filter 64 operatively connected to the second end 61*b* of the first radiant section 61. Such bandpass filter 64 according to the invention, is configured to resonate in a frequency range substantially comprised between 159 MHz and 163 MHz; in other words, such bandpass filter acts like a short-circuit for currents having the frequency thereof comprised in the aforementioned range between 159 MHz and 163 MHz, while it acts like an open circuit for frequencies outside such range.

The aforementioned bandpass filter 64 preferably but not necessarily comprises a resonant L-C filter within the aforementioned frequency range substantially comprised between 159 MHz and 163 MHz.

Furthermore, the radiant unit 6 comprises a second radiant section 62 connected to the bandpass filter 64.

More precisely, the bandpass filter 64 is interposed between the aforementioned two radiant sections 61 and 62.

As concerns such second radiant section 62, in particular, it is configured so as to collaborate with the first radiant section 61, the third radiant section 63 if present, the bandpass filter 64 and the conductive column 65 so as to transmit and receive, in association with the first radiant element 3 and the second radiant element 5, in the frequency range substantially comprised between 159 MHz and 163 MHz.

In other words, given that, as previously mentioned, the bandpass filter 64, at such frequency range between 159 MHz and 163 MHz acts as a short-circuit, the entirety of the elements that the radiant unit 6 is provided with, act as a single radiant element capable of transmitting and receiving within the latter frequency range.

Preferably, the overall length taken by such three components in the antenna 1 of the invention is comprised between 348 and 468 mm, particularly about 408 mm.

Thus, the configuration of the radiant unit 6 described above advantageously enables substantially exploiting the same radiant element to simultaneously operate in the two VHF transception frequency bands between 159 MHz and 163 MHz and between 216 MHz and 223 MHz, very narrow but simultaneously very distant from each other to make it otherwise impossible to design a 159 MHz to 223 MHz broadband, due to the strict compactness dimensional requirements limitations, especially height-wise, in particular required in the railway sector due to the need of trains passing through a tunnel.

In other words, the dimensions of a radiant element capable of operating with a 159 MHz to 223 MHz broadband are markedly higher than the aforementioned solution defined in the multiband antenna 1 of the invention. Thus, the solution of the radiant unit 6 of the multiband antenna 1 of the invention enables simultaneous operation in the two VHF frequency bands from 159 MHz to 163 MHz and from 216 MHz to 223 MHz, simultaneously meeting the strict dimensional limitations, especially height-wise, in particular required in the railway sector due to the need of trains passing through a tunnel.

Figure 6:
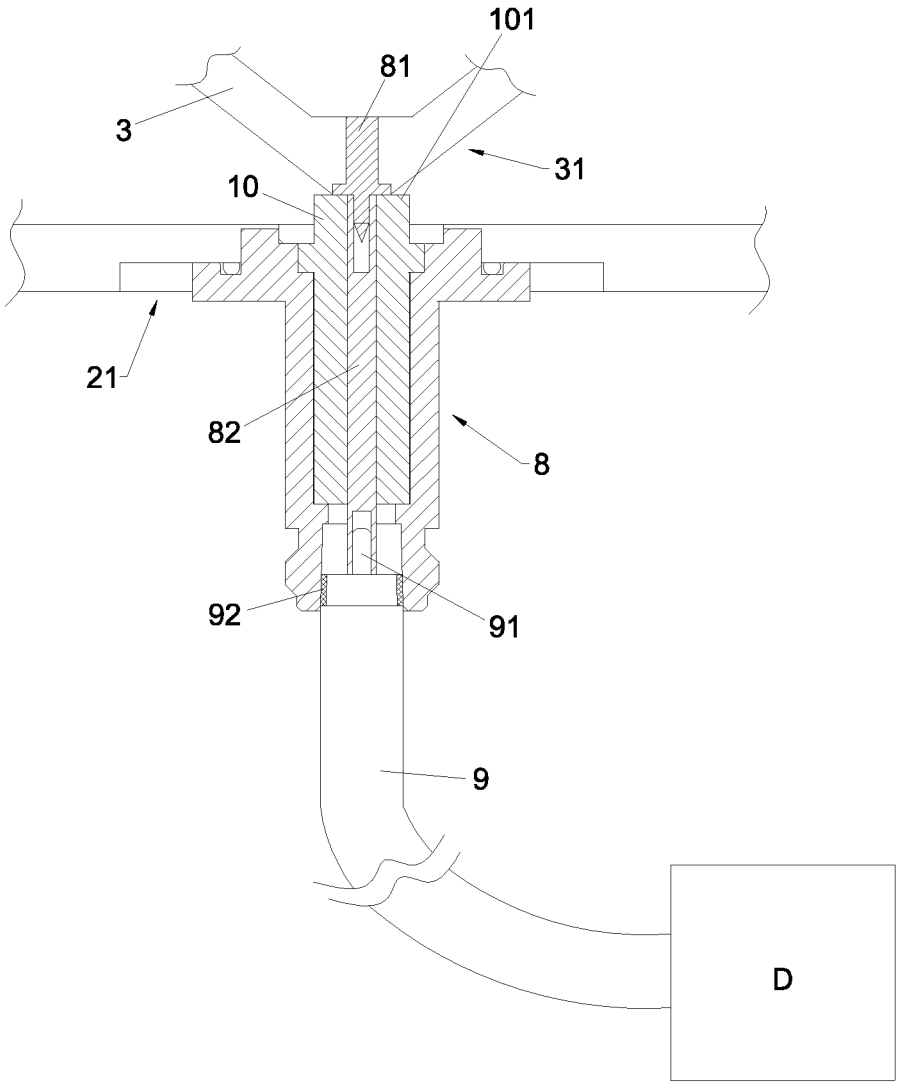
FIG. 6 represents—in sectional view—the detail of the connection means between the multiband antenna of the invention and the RF coaxial cable for interface towards the external.

In addition, as regards the multiband antenna 1 of the invention, as observable in FIG. 2 and in the detail of FIG. 6, it comprises electrical connection means 8 suitable to enable connection thereof with an external device D. In detail, such electrical connection means 8 are suitably mechanically and electrically connected to the vertex 31 of the aforementioned first radiant element 3.

Even more in detail, the preferred embodiment of the invention, provides for that such electrical connection means 8 comprise a male conductive contact 81, or male conductive pin 81, and a female conductive contact 82, or female conductive pin 82. In particular, the male conductive contact 81 is defined on the aforementioned vertex 31 of the first radiant element 3. Such male conductive contact 81 is configured to be reversibly mechanically and electrically connected to the female conductive contact 82 which is in turn arranged passing through a hole 21 obtained in the base element 2, as observable in FIG. 4. The female conductive contact 82 can be associated to the central conductor 91 of an RF coaxial cable 9, so as to establish an electrical continuity between the aforementioned male conductive contact 81, and thus between the radiant elements and sections belonging to the antenna 1 of the invention, and the aforementioned external device D.

As regards the male conductive contact 81 once again, it is preferably but not necessarily integrally obtained in the structure of the first radiant element 3.

However, it is not excluded that the latter, according to a different embodiment, can be obtained as a separate element and only subsequently suitably mechanically and electrically connected at the vertex 31 of such first radiant element 3, and thus to the first radiant element 3.

The latter embodiment advantageously enables obtaining the male conductive contact 81 made of material different from the one that the first radiant element 3 is made of, so as to optimize electrical contact between the female conductive contact 82, or female conductive pin 82, that can be associated to the RF coaxial cable 9 and the male conductive contact 81. Furthermore, such particular embodiment enables obtaining both the first radiant element 3 and the male conductive contact 81 in a simpler and thus less expensive manner.

In any case, the fact that such electrical connection means 8 are obtained with a male conductive contact 81 that can be reversibly mechanically and electrically connected to a female conductive contact 82, generally advantageously enables obtaining a greater ease of assembly of the entire multiband antenna 1 of the invention.

As regards the RF coaxial cable 9, as mentioned previously and represented in FIG. 6, it is connected with the external conductor 92 thereof at electrical contact with the base element 2 so as to define a common earthing between the base 2 and the external device D. The electrical insulation between the external conductor 92, arranged at electrical contact with the base 2, and the male conductive contact 81 and female conductive contact 82 assembly is obtained by means of the insulating element 10 made of Teflon (Polytetrafluoroethylene PTFE) as observable in FIG. 6.

In particular, the insulating element 10 made of Teflon, as observable in FIG. 6, preferably extends above the upper surface of the base element 2.

Such raised insulating element 10 advantageously enables also defining a support surface 101 for the vertex 31 of the first radiant element 3, thus boosting the stability and mechanical robustness of the entire structure of the multiband antenna 1 of the invention.

Lastly, according to the preferred embodiment of the invention, the multiband antenna 1 provides for a radome 11 made of dielectric material and configured to insulate the first radiant element 3, the second radiant element 5, the radiant unit 6 and the support element 7 from the external environment. As observable in FIG. 2, in particular, such radome 11 is configured to be hermetically fixed to the base element 2.

Generally, the configuration of the multiband antenna 1 of the invention, in particular, the electrical continuity defined between the aforementioned radiant elements 3, 5 and 6, enables defining a single conductor structure suitable to be connected to the external device D by means of a single RF coaxial cable 9. Thus, advantageously, the multiband antenna 1 of the invention, though capable of receiving and transmitting in a wide range of frequencies, enables, besides reducing the space occupied, in particular height-wise, also facilitating installation on a roof of a vehicle, in particular a locomotive.

According to the preferred embodiment of the invention, all elements forming the aforementioned multiband antenna 1 are assembled and connected to each other by means of reversible connection means, preferably with fastening means of the known type (screws and bolts). Such characteristic enables assembling the multiband antenna 1 in a quick manner, thus reducing assembly and manpower costs in large scale production.

Furthermore, according to the preferred embodiment of the invention, all holes made on the base element 2 to receive such screws are made blind so as to obtain a high degree of protection against seepage for the whole structure of the multiband antenna 1.

However, it is not excluded, according to an alternative embodiment, that the aforementioned screws be replaced by suitable bolts and the relative blind holes be replaced by suitable threaded inserts, so as to provide a high degree of protection against seepage for the entire structure of the multiband antenna 1.

In addition, it is not excluded, according to an alternative embodiment, that such elements forming the antenna 1 can be permanently assembled to each other, for example, by welding.

As regards the external device D to which the multiband antenna 1 is suitable to be connected, it could operate on a single frequency band among those that the antenna 1 is capable of receiving or transmitting, or it could operate in two or more of them simultaneously or in all of them simultaneously.

Thus, in the light of the above, the multiband antenna of the invention attains all the pre-set objects.

In particular, the object of providing a multiband antenna structure with compact dimensions, in particular with a low profile, is attained.

The object of providing a multiband antenna capable of simultaneously operating in a frequency range substantially comprised between 150 MHz and 6 GHz and simultaneously guarantee the required insulation between the various channels, is also attained.

Actually, such insulation between various channels, i.e. between the various operating sub-frequency bands, may be simply obtained by connecting the only output of the antenna of the invention, in particular the only descent RF coaxial cable to a single filtering system ("multiplexer") that can be provided in the vehicles in which the aforementioned antenna is used.

The object of providing a multiband antenna that is sufficiently robust to enable the correct operation thereof even in the presence of vibrations or other external disturbances, like the extremely hard ones known in the railway sector, is also attained.

The object of providing a multiband antenna which, having a single RF coaxial cable for interface with the external, enables an installation thereof in a simple, quick and thus cost-effective manner, is also attained.

A further advantage obtained with the multiband antenna of the invention is observed when there arises the need to provide an architecture of the telecommunication system that requires the use of a plurality of multiband antennas of the same type, thus operating in the same frequency bands, with the aim of obtaining redundancy or diversity patterns. As a matter of fact, the compactness of the multiband antenna of the invention in this case enables increasing the distances between a plurality of such antennas, thus enhancing insulation between two channels, i.e. between two antennas of the same type operating in the same frequency bands in this case, with ensuing increase of the diversity gain.

What is claimed is:

1. A multiband antenna for transmission and reception in a range of frequencies substantially comprised between 150 MHz and 6 GHz, comprising:

a base plate-like conductive element with substantially longitudinal extension and configured to be connected to a connected-mass conductive surface;

a first radiant element with a substantially mono-cone shape mechanically connected with the vertex with said base element, said first radiant element being configured to transmit and receive in a frequency range substantially comprised between 698 MHz and 6 GHz;

a second radiant element with a cylindrical shape mechanically and electrically connected at the upper part with said first radiant element, said second radiant element being configured so as to collaborate with said first radiant element to transmit and receive in a frequency range comprised substantially between 400 MHz and 500 MHz;

a radiant unit comprising:

a first radiant section with substantially longitudinal and plate-like extension having a first end mechanically and electrically connected to the top part of said second radiant element, said first radiant section being arranged substantially in parallel position and at electrical contact with said base element, said first radiant section being configured to transmit and receive in a frequency range comprised substantially between 216 MHz and 223 MHz;

a bandpass filter operatively connected to the second end of said first radiant section, said bandpass filter being configured to resonate in a frequency range substantially comprised between 159 MHz and 163 MHz;

a second radiant section connected to said bandpass filter, said second radiant section being configured so as to collaborate with said first radiant section and said bandpass filter for transmitting and receiving frequency comprised substantially between 159 MHz and 163 MHz;

means for electrically connecting said multiband antenna with an external device, said electrical connection means being mechanically connected to said vertex of said first radiant element.

2. The multiband antenna according to claim 1, wherein said first radiant element is mechanically fixed to said first base element through a plurality of support elements made of insulating material.

3. The multiband antenna according to claim 2, wherein each of said plurality of support elements is arranged between the outer surface of said first radiant element and said base element with an angle substantially equivalent to 90° with respect to said outer surface.

4. The multiband antenna according to claim 2, wherein said plurality of support elements are four support columns.

5. The multiband antenna according to claim 1, wherein said radiant unit comprises a third radiant section with a substantially trapezoidal profile, said third radiant section developing in a direction substantially transverse to said first radiant section and it being mechanically and electrically connected in proximity of said second end of said first radiant section, said third radiant section being moreover configured, together with said first radiant section, to collaborate with said first radiant element and said second radiant element for transmitting and receiving in said frequency range substantially comprised between 216 MHz and 223 MHz.

6. The multiband antenna according to claim 1, wherein said electrical contact between said first radiant section and said base element is obtained by interposing a conductive column belonging to said radiant unit and arranged in proximity of said first end of said first radiant section and in proximity of said first and second radiant element.

7. The multiband antenna according to claim 1, wherein said bandpass filter substantially comprises a resonant LC filter in said frequency range substantially comprised between 159 MHz and 163 MHz.

8. The multiband antenna according to claim 1, wherein said electrical connection means comprise a male conductive contact defined on said vertex of said first radiant element, said male conductive contact being adapted to be mechanically and electrically reversibly connected to a female conductive contact passing through a hole defined on said base element and suitable to be coupled to a central conductor of an RF coaxial cable.

9. The multiband antenna according to claim 1, wherein it provides for a radome made of dielectric material and configured to insulate said first radiant element, said second radiant element, said radiant unit and said support element from the external environment, said radome being configured to be hermetically fixed on said base element.

10. The multiband antenna according to claim 1, wherein said first radiant element has a height comprised between 50 and 70 mm, and a base diameter comprised between 160 and 180 mm.

11. The multiband antenna according to claim 10, wherein said height of said first radiant element is about 60 mm and said diameter of said base is 168 mm.

12. The multiband antenna according to claim 1, wherein the combination of said first radiant element and said second radiant element has a height comprised between 130 and 150 mm.

13. The multiband antenna according to claim 12, wherein said height of said combination of said first radiant element and said second radiant element is about 138 mm.

14. The multiband antenna according to claim 1, wherein said first radiant section of said radiant unit has a length comprised between 298 and 418 mm.

15. The multiband antenna according to claim 14, wherein said length of said first radiant section of said radiant unit is about 358 mm.

* * * * *